US005860599A

United States Patent [19]

Lin

[11] Patent Number: 5,860,599

[45] Date of Patent: Jan. 19, 1999

[54] SHOWER HEAD ASSEMBLY

[76] Inventor: Wen-Yi Lin, No. 62, Hsinan Chuang, Fushan Li, Changhua City, Taiwan

[21] Appl. No.: 919,029

[22] Filed: Aug. 27, 1997

[51] Int. Cl.[6] ..... B05B 1/34

[52] U.S. Cl. ..... 239/443; 239/436; 239/447; 239/380; 239/381

[58] Field of Search ..... 239/436, 437, 239/438, 439, 441, 443, 444, 446, 447, 449, 581.2, 380, 381

[56] References Cited

U.S. PATENT DOCUMENTS

| | | | |
|---|---|---|---|
| 4,117,979 | 10/1978 | Lagarelli et al. | 239/381 |
| 4,131,233 | 12/1978 | Koenig | 239/381 |
| 4,254,914 | 3/1981 | Shames et al. | 239/447 X |
| 4,324,364 | 4/1982 | Buzzi | 239/447 X |
| 4,330,089 | 5/1982 | Finkbeiner | 239/447 X |
| 5,356,077 | 10/1994 | Shames et al. | 239/447 X |
| 5,518,181 | 5/1996 | Shames et al. | 239/381 |
| 5,647,537 | 7/1997 | Bergmann | 239/383 |
| 5,765,760 | 6/1998 | Kuo | 239/437 X |

*Primary Examiner*—Andres Kashnikow
*Assistant Examiner*—Robin O. Evans
*Attorney, Agent, or Firm*—Holland & Hart LLP

[57] ABSTRACT

A shower head assembly includes a housing including a first end portion engaged with a water outlet cap and a second end portion connected to a water source. The water outlet cap defines a plurality of outer nozzles arranged in a circular manner and a plurality of inner nozzles arranged in a circular manner. An adjusting device is mounted on a periphery of the housing for alternatively introducing water in the housing into the outer nozzles or the inner nozzles such that water can be sprayed outwardly via the outer nozzles or via the inner nozzles alternatively.

6 Claims, 5 Drawing Sheets

SHOWER HEAD ASSEMBLY

FIELD OF THE INVENTION

The present invention relates to a shower head assembly.

BACKGROUND OF THE INVENTION

A conventional shower head includes a cone-shaped head coupled with a water outlet cap defining a plurality of nozzles therein for water to spray out therefrom. By such an arrangement, however, a plurality of jets of water are directly sprayed from the nozzles in a radiating manner and cannot be sprayed from the nozzles intermittently, thereby lacking versatility.

The present invention has arisen to mitigate and/or obviate the disadvantage of the conventional shower head.

SUMMARY OF THE INVENTION

In accordance with one aspect of the present invention, there is provided a shower head assembly comprising a housing including a first end portion and a second end portion. An abutting base is fitted in the housing and includes a first side wall abutting on an inner wall of the second end portion of the housing and defining a recess, and a second side wall defining a hole in a center thereof and communicating with the recess.

A circular base is fitted in an inner wall of the first end portion of the housing and includes a first side and a second side, and a plurality of bores arranged in an annular manner are defined in the circular base.

An outer tube includes a first end portion extending from the second side of the circular base and a second end portion abutting on the second side wall of the abutting base. An inner tube includes a first end portion extending from the second side of the circular base and a second end portion abutting on the second side wall of the abutting base and defining a plurality of openings along a periphery thereof. An annular duct is defined between the outer tube and the inner tube and has a first portion communicating with the bores and a second portion communicating with the openings. A tapered collar disposed in the inner tube is formed on the circular base and defines a tapered bore therein.

A sliding barrel is slidably mounted in the inner tube and includes a closed end portion defining a plurality of cavities along a periphery thereof and an open end portion. A channel is defined in the sliding barrel and has a first portion communicating with the cavities and a second portion communicating with the hole of the abutting base.

An urging seat is formed on the closed end portion of the sliding barrel to slide therewith and is movable between a first position where the urging seat is urged on an inner wall of the tapered collar, thereby closing the tapered bore while the open end portion of the sliding barrel is spaced from the second side wall of the abutting base such that the channel communicates with the openings of the inner tube, and a second position where the urging seat is detached from the inner wall of the tapered collar such that each of the cavities communicates the tapered bore while the open end portion of the sliding barrel is urged on the second side wall of the abutting base, thereby closing the openings of the inner tube.

An adjusting means can be provided for moving the sliding barrel together with the abutting seat between the first position and the second position thereof.

Further features of the present invention will become apparent after a careful reading of the detailed description with appropriate reference to the accompanying drawings.

DETAILED DESCRIPTION OF THE PREFERRED EMBODIMENTS

Figure 1:
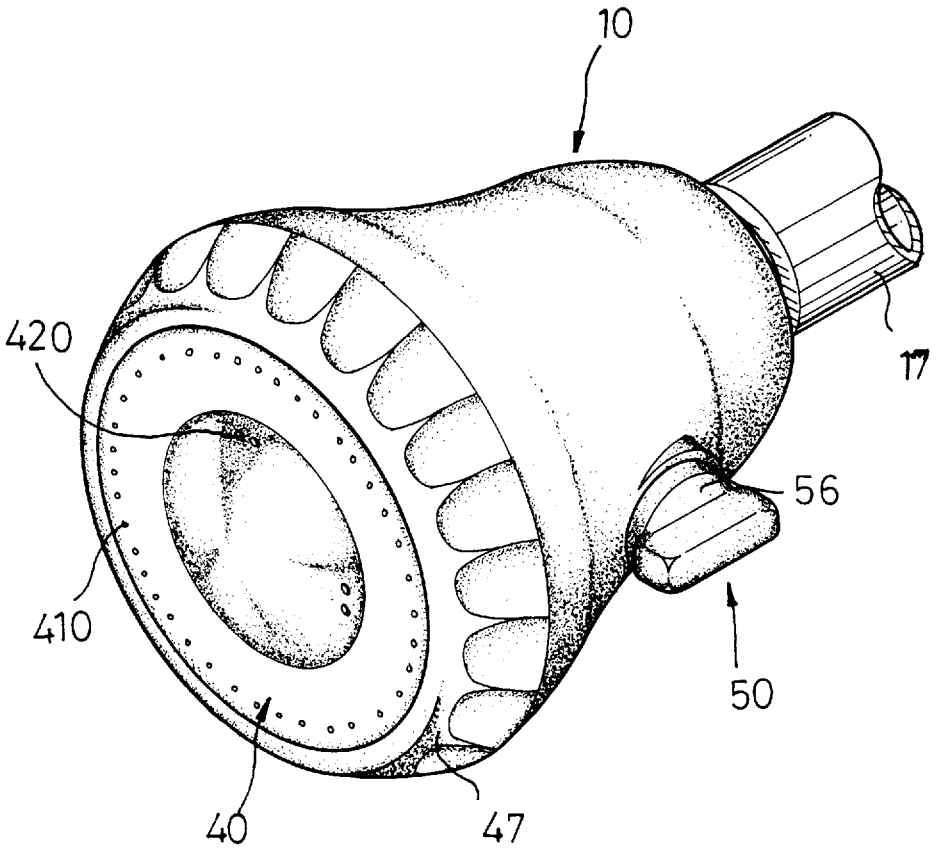
FIG. 1 is a perspective view of a shower head assembly in accordance with the present invention.
Figure 2:
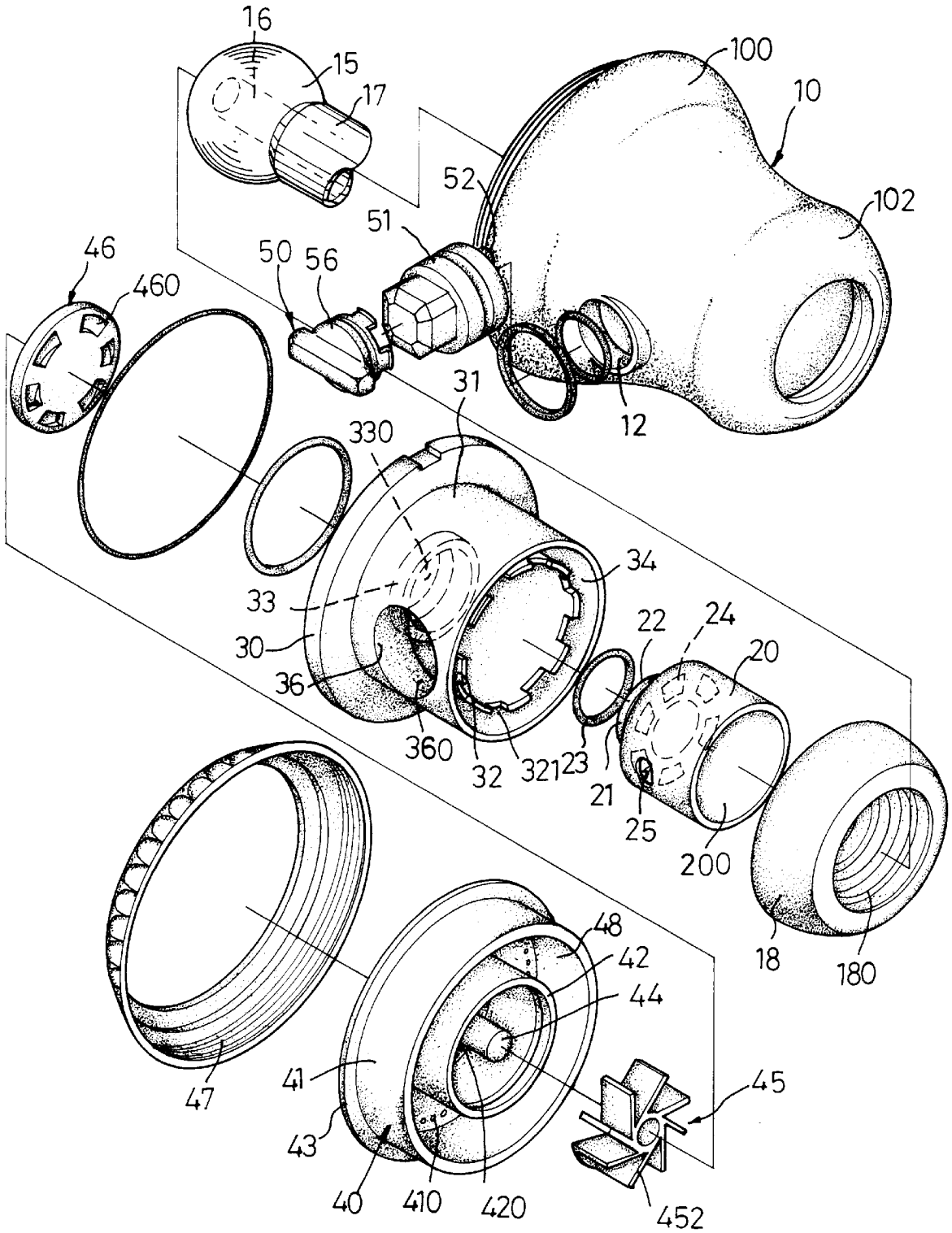
FIG. 2 is an exploded view of the shower head assembly shown in FIG. 1.
Figure 3:
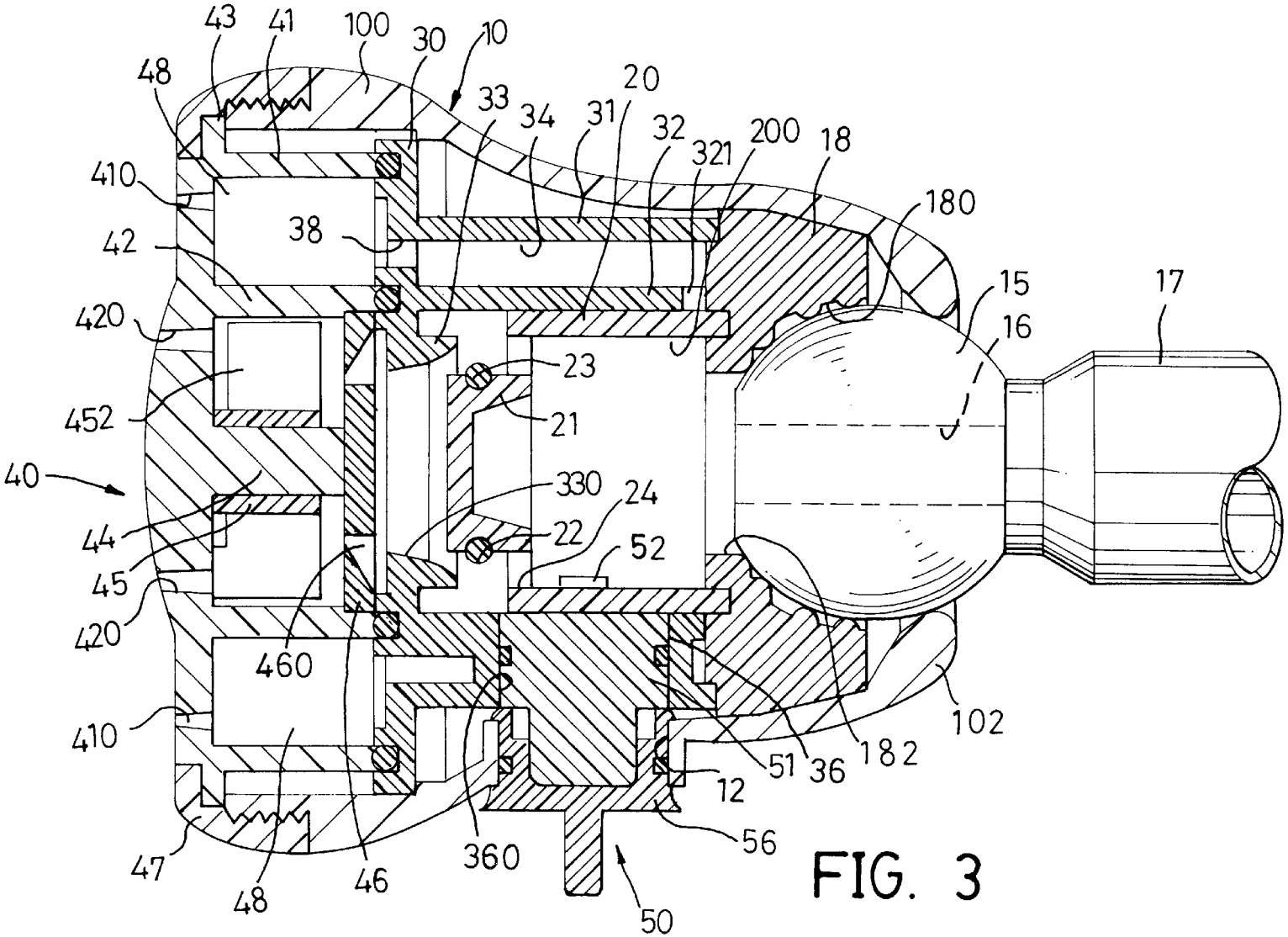
FIG. 3 is a top plan partially cross-sectional view of FIG. 1.

Referring to the drawings, and initially to FIGS. 1–3, a shower head assembly according to the present invention comprises a housing 10 including a first end portion 100 and a second end portion 102.

An abutting base 18 is fitted in the housing 10 and includes a first side wall abutting on an inner wall of the second end portion 102 of the housing 10 and defining a recess 180, and a second side wall defining an inlet hole 182 communicating with the recess 180.

A ball head 15 retained by the inner wall of the second end portion of the housing 10 is rotatably mounted in the recess 180 and defines a passage 16 communicating with the inlet hole 182. A coupling 17 is engaged with the ball head 15 for supplying water from a water source (not shown) into the inlet hole 182 via the passage 16 of the ball head 15.

A circular base 30 fitted in an inner wall of the first end portion 100 of the housing 10 includes a first side and a second side, and defines a plurality of bores 38 arranged in an annular manner.

An outer tube 31 includes a first end portion extending from the second side of the circular base 30 and a second end portion abutting on the second side wall of the abutting base 18.

An inner tube 32 includes a first end portion extending from the second side of the circular base 30 and a second end portion abutting on the second side wall of the abutting base 18 and defining a plurality of tooth-shaped openings 321 along a periphery thereof.

The bores 38 defined in the circular base 30 are each located between the inner tube 32 and the outer tube 31. An annular duct 34 is defined between the outer tube 32 and the inner tube 31 and has a first portion communicating with the bores 38 and a second portion communicating with the openings 321.

A tapered collar 33 disposed in the inner tube 32 is formed on the circular base 30 and defines a tapered bore 330 therein.

A sliding barrel 20 is slidably mounted in the inner tube 32 and has a closed end portion defining a plurality of cavities 24 along a periphery thereof, and an open end portion. A channel 200 is defined in the sliding barrel 20 and has a first portion communicating with the cavities 24 and a second portion communicating with the inlet hole 182 of the abutting base 18.

A cylindrical urging seat 21 is formed on the closed end portion of the sliding barrel 20 to slide therewith and defines an annular groove 22 in a periphery thereof. A sealing ring 23 is mounted in the annular groove 22 and can be detachably urged on an inner wall of the tapered collar 33.

A water outlet cap 40 includes a disk 43 abutting on the first end portion 100 of the housing 10, an outer ring 41 having a first end portion extending from the disk 43 and a second end portion abutting on the first side of the circular base 30, and an inner ring 42 having a first end portion extending from the disk 43 and a second end portion abutting on the first side of the circular base 30. An annular space 48 is defined between the inner ring 42 and the outer ring 41 and communicates with the outer nozzles 410 and the bores 38.

A plurality of outer nozzles 410 disposed between the outer and inner rings 41 and 42 are each defined in the disk 43 and each communicate with the bores 38 of the circular base 30, and a plurality of inner nozzles 420 disposed in the inner ring 42 are each defined in the disk 43 and each communicate with the tapered bore 330.

A rotary disk 46 rotatably abuts on the first side of the circular base 30 and defines a plurality of chutes 460 communicating with the tapered bore 330. A pivot axle 44 disposed in the inner ring 42 includes a first end portion extending from the disk 43 and a second end portion abutting on the rotary disk 46. A rotary base 45 is rotatably mounted on the pivot axle 44 and includes a plurality of blades 452 arranged in a circular manner.

A positioning member 47 is fixedly mounted on the first end portion 100 of the housing 10 and is urged on the disk 43 of the water outlet cap 40 for positioning the water outlet cap 40 in the housing 10.

An adjusting device is mounted on a periphery of the housing 10 for displacing the sliding barrel 20 together with the abutting seat 21.

The housing 10 defines a first socket 12 in a periphery thereof, a reinforcing wall 36 is formed between the outer tube 31 and the inner tube 32 and defines a second socket 360 aligning with the first socket 12, and the sliding barrel 20 defines an oblong slot 25 in a periphery thereof and aligning with the second socket 360.

The adjusting device 50 comprises a cylindrical pivot base 51 rotatably extending through the first and second sockets 12 and 360, an eccentric stub 52 eccentrically extending from a first end portion of the pivot base 51 to rotate therewith and slidably received in the oblong slot 25, and a knob 56 detachably fixedly mounted on a second end portion of the pivot base 51 and extending outwardly from the housing 10 for rotating the pivot base 51.

Figure 4:
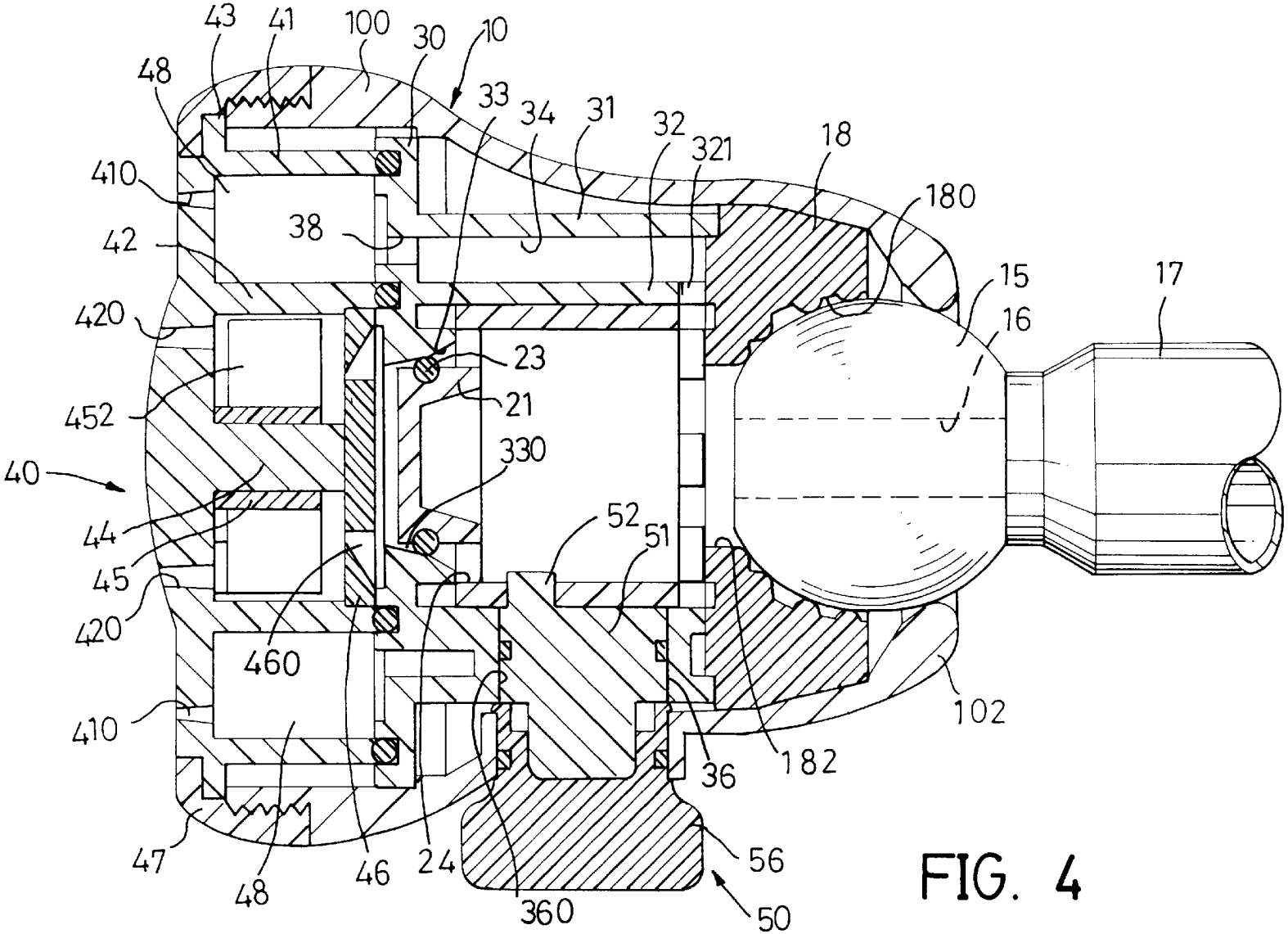
FIG. 4 is an operational view of FIG. 3.
Figure 5:
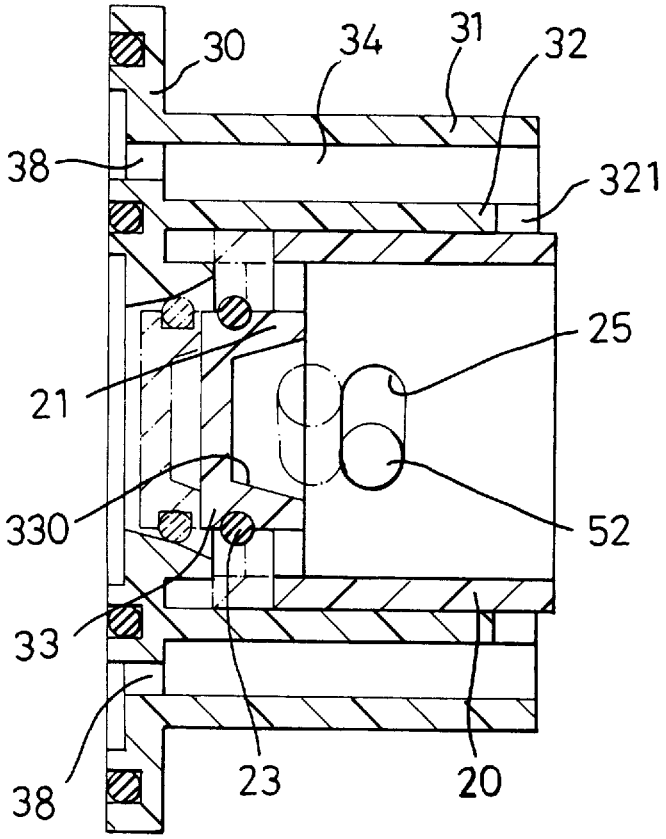
FIG. 5 is a cut-away front plan partially cross-sectional operational view of FIG. 1.

In operation, referring now to FIGS. 3–5 with reference to FIGS. 1 and 2, the eccentric stub 52 is initially received in a position as shown in FIG. 3 and shown in solid lines in FIG. 5.

In such a situation, the sliding barrel 20 together with the urging seat 21 is located at its first position where the sealing ring 23 is detached from the inner wall of the tapered collar 33 such that each of the cavities 24 communicates with the tapered bore 330 while the open end portion of the sliding barrel 20 is urged on the second side wall of the abutting base 18, thereby closing the openings 321 of the inner tube 32.

By such an arrangement, water supplied via the inlet hole 182 can be introduced into the channel 200 and can then be introduced into the tapered bore 330 via the cavities 24.

Then, water from the tapered bore 330 can be brought through the chutes 460 of the rotary disk 46 and the blades 452 of the rotary base 45 and can finally be sprayed to surroundings via the plurality of inner nozzles 420.

When water is driven through the tapered bore 330 into the chutes 460, water can be accelerated due to a convergent effect of the tapered bore 330 such that the force exerted on inclined surfaces of the chutes 460 by an impact pressure caused by the accelerated water can be transformed into a rotational force, thereby in turn rotating the rotary disk 46.

At the same time, water delivered through the chutes 460 can be sprayed to impact the blades 452 in a radiating manner, thereby rotating the rotary base 45 such that water can be sprayed from the inner nozzles 420 intermittently.

Then, the knob 56 can be turned to rotate the pivot base 51, thereby displacing the eccentric stub 52 from a first position as shown in FIG. 3 to a second position as shown in FIG. 4.

Especially referring to FIG. 5, when the eccentric stub 152 is rotated with the pivot base 51 from the first position as shown in solid lines to the second position as shown in phantom lines, the eccentric stub 52 can also slide along the oblong slot 25, thereby moving the sliding barrel 20 leftward.

In such a situation, the sliding barrel 20 together with the urging seat 21 can be moved to a second position as shown in FIGS. 4 and 5 where the sealing ring 23 is urged on the inner wall of the tapered collar 33, thereby closing the tapered bore 330 while the open end portion of the sliding barrel 20 is spaced from the second side wall of the abutting base 18 such that the channel 200 communicates with the openings 321 of the inner tube 32.

By such an arrangement, water supplied via the inlet hole 182 into the channel 200 can be introduced into the annular duct 34 through the openings 321 and can then be introduced into the annular space 48 via the bores 38.

Finally, water flowing through the annular space 48 can be sprayed to surroundings via the plurality of outer nozzles 410.

It should be clear to those skilled in the art that further embodiments of the present invention may be made without departing from the scope and spirit of the present invention.

What is claimed is:

1. A shower head assembly comprising:

a housing (10) including a first end portion (100) and a second end portion (102);

an abutting base (18) fitted in said housing (10) and including a first side wall abutting on an inner wall of said second end portion (102) of said housing (10) and defining a recess (180), and a second side wall defining a hole (182) communicating with said recess (180);

a circular base (30) fitted in an inner wall of said first end portion (100) of said housing (10) and including a first side and a second side, and a plurality of bores (38) defined in said circular base (30) and arranged in an annular manner;

an outer tube (31) including a first end portion extending from said second side of said circular base (30) and a second end portion abutting on said second side wall of said abutting base (18);

an inner tube (32) including a first end portion extending from said second side of said circular base (30) and a second end portion abutting on said second side wall of said abutting base (18) and defining a plurality of openings (321) along a periphery thereof, an annular duct (34) defined between said outer tube (32) and said inner tube (31) and having a first portion communicating with said bores (38) and a second portion communicating with said openings (321);

a tapered collar (33) formed on said circular base (30) and disposed in said inner tube (32), and a tapered bore (330) defined in said tapered collar (33);

a sliding barrel (20) slidably mounted in said inner tube (32) and including a closed end portion defining a plurality of cavities (24) along a periphery thereof, and an open end portion, a channel (200) defined in said sliding barrel (20) and having a first portion communicating with said cavities (24) and a second portion communicating with said hole (182) of said abutting base (18);

an urging seat (21) extending from said closed end portion of said sliding barrel (20) to slide therewith and being movable between a first position where said urging seat (21) is detached from an inner wall of said tapered collar (33) such that said cavities (24) communicate with said tapered bore (330) while said open end portion of said sliding barrel (20) is urged on said second side wall of said abutting base (18), thereby closing said openings (321) of said inner tube (32), and a second position where said urging seat (21) is urged on said inner wall of said tapered collar (33), thereby closing said tapered bore (330) while said open end portion of said sliding barrel (20) is spaced from said second side wall of said abutting base (18) such that said channel (200) communicates with said openings (321) of said inner tube (32); and adjusting means (50) for moving said sliding barrel (20) together with said abutting seat (21) between said first position and said second position.

2. The shower head assembly according to claim 1, wherein said housing (10) defines a first socket (12) in a periphery thereof, a reinforcing wall (36) is formed between said outer tube (31) and said inner tube (32) and defines a second socket (360) aligning with said first socket (12), said sliding barrel (20) defines an oblong slot (25) in a periphery thereof and aligning with said second socket (360), and said adjusting means (50) comprises a pivot base (51) in turn rotatably extending through said first socket (12) and said second socket (360), an eccentric stub (52) eccentrically extending from a first end portion of said pivot base (51) to rotate therewith and slidably received in said oblong slot (25), and a knob (56) fixedly mounted on a second end portion of said pivot base (51) and extending outwardly from said housing (10) for rotating said pivot base (51).

3. The shower head assembly according to claim 1, wherein said urging seat (21) defines an annular groove (22) in a periphery thereof, and a sealing ring (23) is mounted in said annular groove (22) and can be tightly urged on said inner wall of said tapered collar (33) when said urging seat (21) is at its first position, and can be detached from said inner wall of said tapered collar (33) when said urging seat (21) is at its second position.

4. The shower head assembly according to claim 1, further comprising a cap (40) including a disk (43) abutting on said first end portion (100) of said housing (10), an outer ring (41) including a first end portion extending from said disk (43) and a second end portion abutting on said first side of said circular base (30), an inner ring (42) including a first end portion extending from said disk (43) and a second end portion abutting on said first side of said circular base (30), a plurality of outer nozzles (410) defined in said disk (43), disposed between said outer and inner rings, and communicating with said bores (38), and a plurality of inner nozzles (420) defined in said disk (43), disposed in said inner ring (42), and communicating with said tapered bore (330).

5. The shower head assembly according to claim 4, further comprising a rotary disk (46) rotatably abutting on said first side of said circular base (30) and defining a plurality of chutes (460) communicating with said tapered bore (330), a pivot axle (44) disposed in said inner ring (42) and including a first end portion extending from said disk (43) and a second end portion abutting on said rotary disk (46), a rotary base (45) rotatably mounted on said pivot axle (44) and including a plurality of blades (452) arranged in a circular manner.

6. The shower head assembly according to claim 4, further comprising a positioning member (47) fixedly mounted on said first end portion (100) of said housing (10) and urged on said disk (43) of said cap (40) for positioning said cap (40) in said housing (10).

* * * * *